United States Patent [19]

Teti, Jr.

[11] Patent Number: 4,480,399

[45] Date of Patent: Nov. 6, 1984

[54] NAMEPLATE MANUFACTURING

[75] Inventor: Joseph A. Teti, Jr., Haverford, Pa.

[73] Assignee: LaFrance Corporation, Philadelphia, Pa.

[21] Appl. No.: 491,606

[22] Filed: May 4, 1983

[51] Int. Cl.[3] ..... G09F 7/00

[52] U.S. Cl. ..... 40/584; 40/594; 40/618

[58] Field of Search ..... 40/594, 595, 618, 620, 40/621, 584

[56] References Cited

U.S. PATENT DOCUMENTS

| | | | |
|---|---|---|---|
| 2,211,937 | 8/1940 | Register | 40/618 |
| 2,250,583 | 7/1941 | Krauter | 40/618 |
| 2,584,253 | 2/1952 | Braun | 40/618 |
| 2,755,576 | 7/1956 | Golden | 40/594 |
| 2,775,048 | 12/1956 | Berman | 40/620 |
| 3,343,289 | 9/1967 | Chamberlin | 40/159 |
| 3,593,449 | 7/1971 | Nielson | 40/618 |
| 3,734,816 | 5/1973 | Swasey | 40/594 |
| 4,340,976 | 7/1982 | Wright | 40/595 |

*Primary Examiner*—John J. Wilson

*Attorney, Agent, or Firm*—Connolly and Hutz

[57] ABSTRACT

A nameplate or the like is made by providing an open-type frame which has an opening extending completely therethrough. The front face of the frame is recessed. Insert members having, for example, individual letters are placed in the recess. Each insert has a tongue which fits in the opening and which has its outer face co-planar with the outer surface of the frame and the adhesive member is secured across the outer faces of the frame and tongue.

9 Claims, 5 Drawing Figures

NAMEPLATE MANUFACTURING

BACKGROUND OF THE INVENTION

Various techniques exist for making nameplates or the like which would include individual letters or designs selected by the ultimate user. Generally these techniques involve providing the inserts on which the letters are formed with an adhesive backing. The inserts are then pressed against a solid background of a frame member to secure the inserts to the frame member for forming the name or other identification. A second adhesive member or adhesive layer is provided on the back of the frame for then securing the frame to a permanent object such as a door, luggage, etc.

SUMMARY OF INVENTION

An object of this invention is to provide a simplified manner of customizing nameplates.

A further object of this invention is to provide a manner of customizing nameplates which is both economical and encounters little difficulty in practice.

In accordance with this invention, an open frame has a recessed front face with an opening extending completely through the frame. The individual letters or designs are formed on individual inserts. Each insert is constructed so as to fit into the frame recess. Each insert includes a tongue which extends into the frame opening and terminates generally co-planar with the rear face of the frame. An adhesive member preferably in the form of a double faced adhesive strip is secured across the rear walls of the inserts and the rear face of the frame to lock the inserts in place in the frame while providing an adhesive layer for securing the frame in place.

The rear face of the frame may be slightly indented with a peripheral rim formed therearound. The indented surface of the frame would be co-planar with the rear walls of the inserts and the extent of indentation would be such that the adhesive member could be placed in the indent and project slightly beyond the outer surface of the rim. If desired, the forward faces of the inserts may also be flush with the front face of the frame.

THE DRAWINGS

DETAILED DESCRIPTION

Figure 1:
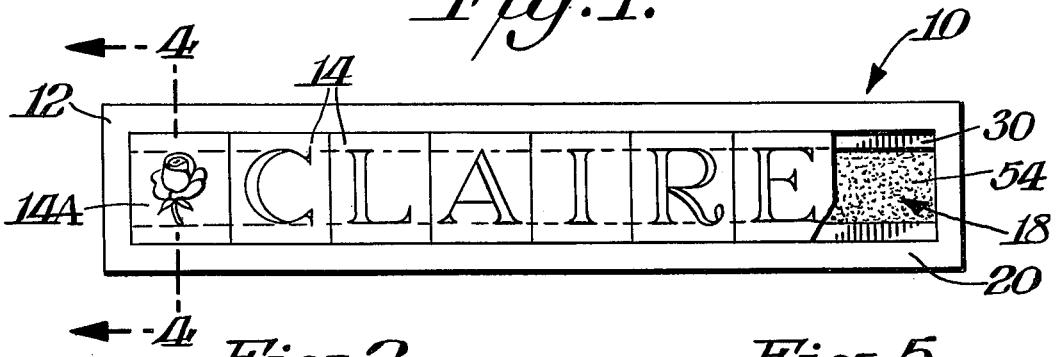
FIG. 1 is a front elevation view partly broken away showing a nameplate in accordance with this invention.
Figure 2:
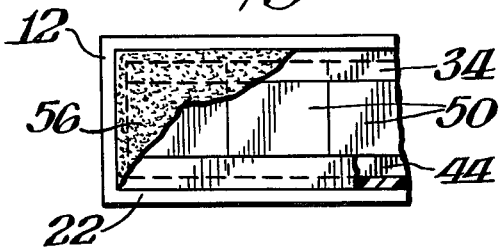
FIG. 2 is a rear elevation view partly broken away of a portion of the nameplate shown in FIG. 1.

The nameplate 10 in accordance with this invention includes an open frame member 12, a plurality of inserts 14 and an adhesive member 16. Frame 12 is of open construction having an opening 18 extending completely therethrough. Frame 12 includes a front face 20 and a rear face 22. A peripheral recess 24 is formed in the front face 20 thereby creating a stepped formation which includes an outermost surface 26, a peripheral side wall 28 and a shoulder 30 having a peripheral edge 32 which defines the opening 18.

In a preferred form of this invention, the outermost surface 22 of frame 12 includes an indented portion or flat surface 34 with an upstanding rim 36 joining indented surface 34 and exposed surface 38.

As illustrated, a plurality of individual inserts 14 would be provided which could be arranged in various combinations to form customized indicia. For example, FIG. 1 illustrates the letters CLAIRE which could be used to form a name. Filler type inserts such as 14A being blank or having designs could be used so that the entire recess of frame 12 would be filled. Obviously any variety of letters, designs and the like could be used as the indicia on inserts 14 including multiple letters on the same indicia.

Each insert 14 includes a forward face 40 on which the indicia is formed and also includes a rearward face 42. The rearward face is of stepped construction having a pair of shoulders 44 and an outwardly extending tongue 46. Tongue 46 includes a side wall 48 and a rear wall 50. Tongue 46 is so dimensioned that it would singly fit in recess 18 with shoulders 44 of insert 14 pressing against shoulder 30 of frame 12. Additionally peripheral edge 32 of frame 12 would be in contact with side wall 48 of insert 14. The assembly of an insert 14 to frame 12 is best illustrated in FIG. 4.

As can be appreciated in order to form a customized nameplate or the like, the user would select the proper inserts and place each insert into frame 12 so that the entire recess 24 of frame 12 is completely filled. Within the broad concepts of this invention, it is not necessary to completely fill the recess. For aesthetic reasons, however, a complete filling is preferred.

Figure 3:
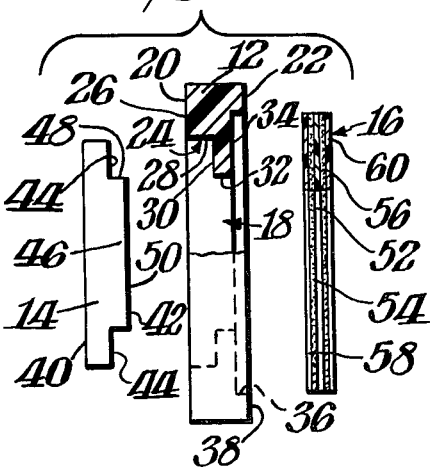
FIG. 3 is an exploded view of the components used for forming the nameplate of FIGS. 1–2.

After the inserts 14 have been mounted in frame 12, it is necessary to secure the frame and inserts together. This is accomplished by the utilization of adhesive member 16. In the preferred practice of the invention, adhesive member 16 includes a base member 52 having an adhesive surface 54 on one side thereof and another adhesive surface 56 on the remote side. (See FIG. 4.) As shown in FIG. 3, the adhesive surfaces 54 and 56 would be protected by removable strips 58, 60. When it is time to use adhesive member 16, strip 58 would be removed thereby exposing adhesive layer 54. Adhesive member 16 would then be placed against indented surface 34 and also against the rear walls of the various inserts 14 so as to adhere to the frame and inserts. The arrangement of this invention is particularly advantageous because the flat rear walls of inserts 14 provide an extended surface area or land to which the adhesive layer 54 may be secured. Once secured in this manner, the inserts themselves are held in place by means of the stepped construction of the inserts and frame on the one side and the adhesive on the other side. The assemblage of inserts 14 being secured in frame 12 by means of adhesive member 16 may then be stored until it is desired to mount the nameplate 10 in its permanent location. At that time strip 60 is removed and adhesive layer 56 is then exposed which may be placed in contact with the permanent mounting member by pressing the nameplate against the mounting member.

Figure 5:
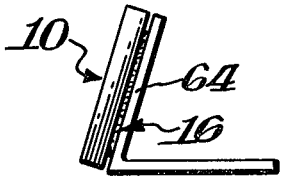
FIG. 5 is a side elevation view of the nameplate shown in FIGS. 1–3 showing an alternative manner of mount.
Figure 4:
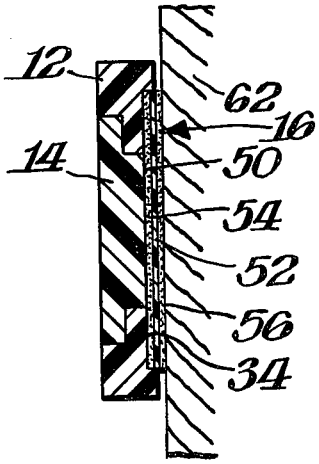
FIG. 4 is a cross-sectional view taken through FIG. 1 along the line 4—4 and showing the nameplate mounted to a flat surface.

FIG. 4 illustrates one manner of mounting nameplate 10 wherein the mounting member 62 is a vertical surface such as a door or wall. FIG. 5 illustrates an alternative arrangement wherein an angular mounting member 64 is provided as conventionally used with desk nameplates, and nameplate 10 is secured to the inclined portion of angular member 64.

The nameplate 12 may be used for any suitable application including but not limited to car doors, brief cases, luggage, desk nameplates, office doors, walls, mail boxes, truck doors, car dealer nameplates, etc. As indicated above, the initials or indicia on the inserts 14 would be supplied without any adhesive secured thereto. Additionally the frames 12 would be supplied with loose pieces of double sided adhesive strip 16 having protective paper on both sides. When the user has made his purchase, the user would select the appropriate indicia and a corresponding frame having the adhesive strip dimensioned for that frame. The user would either place the inserts 14 in the frame 12 and then supply the adhesive strip 16, or preferably the user would apply adhesive strip 16 to frame 12 before the inserts 14 are permanently located in place. In this practice, each insert 14 would then be pressed into frame 12 and against adhesive strip 16. Once all of the inserts 14 are in place, the release paper 60 would be removed, and the frame with its letters or indicia would be affixed to the desired permanent object. The practice of this invention eliminates the use of adhesive on the letters themselves and the use of a double sided adhesive eliminates the necessity for having two separate adhesive surfaces.

In the illustrated embodiment, opening 18 is shown as a central opening symmetrically located in frame 12. It is to be understood, however, that opening 18 need not be centrally located. For example, opening 18 may be located in a smaller area to one side of frame 12. Frame 12 may then include permanent indicia such as a company name or a job title and the individual's name may be located in opening 18. Similarly frame 12 may include a plurality of openings 18 for reception of different indicia from inserts 14.

What is claimed is:

1. A nameplate or the like comprising an open frame having a front face and a rear face thereof, said open frame having an opening extending completely therethrough, a peripheral recess in said front face resulting in an outermost surface and a shoulder spaced inwardly from said outermost surface, at least one insert member having a forward face and a rearward face with indicia in the form of a letter or the like being on said forward face, a tongue extending outwardly from said rearward face into said frame opening, said frame opening having a peripheral edge, said tongue having a peripheral side wall and a rear wall, spaced portions of said side wall contacting spaced portions of said edge to minimize movement of said insert upon insertion of said insert into said frame, said rear wall of said tongue being generally co-planar with said rear face of said frame, and an adhesive member adhesively secured across said rear wall and said rear face.

2. The nameplate of claim 1 wherein said outermost surface of said frame is indented with a peripheral rim extending around an indented surface, said adhesive member being located against said indented surface and against said rim.

3. The nameplate of claim 2 wherein said adhesive member is a double sided adhesive strip.

4. The nameplate of claim 3 wherein a protective sheet is secured to the outermost side of said strip.

5. The nameplate of claim 4 wherein said outermost side of said strip extends slightly beyond said outermost surface of said frame.

6. The nameplate of claim 1 including a plurality of said inserts which jointly form a preselected designation.

7. The nameplate of claim 6 wherein said plurality of inserts includes at least one filler insert whereby said inserts completely fill said peripheral recess.

8. A method of forming a nameplate or the like comprising providing an open frame having a recessed front face with an opening extending completely therethrough, securing a double sided adhesive strip to the rear face of said frame with an adhesive surface exposed through said recess, placing preselected inserts into said recess with each insert having a shoulder in contact with the peripheral recess and with each insert having a tongue extending into the frame opening and against the adhesive surface.

9. The method of claim 8 wherein the adhesive strip is a double sided adhesive and including the steps of removing a protective sheet from the outermost adhesive face, and mounting the nameplate to an object by pressing the nameplate against the object for adhesively securing the nameplate to the object.

* * * * *